US006785909B1

(12) United States Patent
Li

(10) Patent No.: US 6,785,909 B1
(45) Date of Patent: Sep. 7, 2004

(54) SPORTS GUARD WITH IMPROVED SHOCK-ABSORBING CAPACITY

(76) Inventor: Kao-Ming Li, No. 1-14, Ma Dow Kou, Ma Kou Li, Ma Dow Chen, Tainan Hsien (TW)

( * ) Notice: Subject to any disclaimer, the term of this patent is extended or adjusted under 35 U.S.C. 154(b) by 0 days.

(21) Appl. No.: 10/424,677

(22) Filed: Apr. 28, 2003

(51) Int. Cl.[7] ..... A61F 9/00
(52) U.S. Cl. ..... 2/16
(58) Field of Search ..... 2/455, 16, 161.1, 2/162, 22, 24; 128/878, 879, 881; 602/6, 7, 21, 64, 26

(56) References Cited

U.S. PATENT DOCUMENTS

| | | | | |
|---|---|---|---|---|
| 1,253,260 A | | 1/1918 | Levinson | |
| 2,759,189 A | * | 8/1956 | Cole | 2/24 |
| 3,044,075 A | * | 7/1962 | Rawlings | 2/22 |
| 3,496,573 A | | 2/1970 | Kucher et al. | |
| 4,484,360 A | * | 11/1984 | Leighton et al. | 2/22 |
| 4,513,449 A | * | 4/1985 | Donzis | 2/462 |
| 5,207,430 A | | 5/1993 | Goins | |
| 5,222,256 A | | 6/1993 | Wang | |
| 5,313,667 A | | 5/1994 | Levine | |
| 5,330,391 A | | 7/1994 | Mitchell | |
| 5,339,465 A | | 8/1994 | Kyewski | |
| 5,435,007 A | | 7/1995 | Kalvestran et al. | |
| 5,445,566 A | | 8/1995 | Hayes | |
| 5,566,389 A | | 10/1996 | Li | |
| 5,594,954 A | | 1/1997 | Huang | |
| 5,600,849 A | | 2/1997 | Hu | |
| 5,813,050 A | | 9/1998 | Popowski | |
| 5,983,408 A | | 11/1999 | Li | |

* cited by examiner

*Primary Examiner*—Tejash Patel
(74) *Attorney, Agent, or Firm*—Alan D. Kamrath; Nikolai & Mersereau, P.A.

(57) ABSTRACT

A sports guard includes a hollow body having a pad attached to a side thereof. The pad includes a substrate and an outer layer. The substrate includes a first shock absorbing member. A second shock absorbing member is embedded into at least one section of an inner face of the first shock absorbing member. The second shock absorbing member has a shock absorbing capacity greater than that of the first shock absorbing member and is located in a position corresponding to a joint of a user wearing the sports guard. By such an arrangement, transmission of an external impact to the joint is almost impossible.

3 Claims, 8 Drawing Sheets

PRIPR ART

SPORTS GUARD WITH IMPROVED SHOCK-ABSORBING CAPACITY

BACKGROUND OF THE INVENTION

1. Field of the Invention

The present invention relates to a sports guard for sports with improved shock-absorbing capacity.

2. Description of the Related Art

Outdoor activities such as fast skating and grass skiing are popular among young people. It is, however, not uncommon to see fracture and injury to the joints resulting from impacts during sporting activities. Further, accumulation of the impacts result in compression fracture as well as injury to the cartilage of the joints. A wide variety of sports guards have heretofore been provided to protect sportsmen from being injured to the knees, elbows, wrists, etc. A typical sports guard includes a shock absorbing material (e.g., sponge) covered by abrasion-resistant outer layers made of, e.g., leather, nylon, or elastic silk. Straps are provided to secure the sports guard on the part of the user to be protected. For protecting the wrist, U.S. Pat. No. 5,566,389 proposes a shock absorbing wrist guard including a shock absorbing device that has a plate, two wings extending from the flat plate, an arcuate portion bridged above a portion of the flat plate which is located between the wings, thereby defining a space between the arcuate portion and the flat plate. A plurality of cushion elements are formed in the space and connected between the arcuate portion and the flat plate portion for absorbing an external reactive force transmitted through the arcuate portion. Nevertheless, the cost is increased, and the shock-absorbing effect of the wrist guard is insufficient or not uniform in some cases.

U.S. Pat. No. 5,983,408 discloses a wrist guard for increasing shock-absorbing capacity. As illustrated in FIG. 1 of the drawings, the wrist guard disclosed in U.S. Pat. No. 5,983,408 includes a glove-like body 11, two straps 12 secured to the body 11, and a guard device 2 provided to a lower portion of the glove-like body 11. The guard device 2 includes a substrate 20, a first resilient arcuate plate 21 projecting from the substrate 20, and a second resilient arcuate plate 22 projecting from the substrate 20 toward the first resilient arcuate plate 21 and having an end in contact with an inner end edge of the distal end of the first resilient arcuate plate 21. The curvature of the second resilient arcuate plate 22 has a vertex which has a distance to the substrate 20 longer than a distance between the distal end of the first arcuate plate and the substrate 20. When the guard device touches the ground as a result of falling, as illustrated in FIG. 2, the second arcuate plate 22 is deformed, with the distal end of the second arcuate plate 22 in contact with an inner end of the first arcuate plate 21, thereby absorbing the relative larger impact so that no impact is transmitted to the wrist. Nevertheless, compression fracture and injury to the cartilage of the joints are still problems to sportsmen even if they wear the wrist guard. The present invention is intended to provide an improved sports guard for increasing the shock-absorbing capacity, which would be extremely useful in protecting the fragile parts of a human body, avoiding occurrence of compression fracture as well as injury to the cartilage of the joints of the user.

SUMMARY OF THE INVENTION

An object of the present invention is to provide an improved sports guard for increasing the shock-absorbing capacity to thereby avoid occurrence of compression fracture as well as injury to the cartilage of the joints of the user.

A sports guard in accordance with the present invention includes a hollow body having a pad attached to a side thereof. The pad includes a substrate and an outer layer. The substrate includes a first shock absorbing member. A second shock absorbing member is embedded into at least one section of an inner face of the first shock absorbing member. The second shock absorbing member has a shock absorbing capacity greater than that of the first shock absorbing member and is located in a position corresponding to a joint of a user wearing the sports guard. By such an arrangement, transmission of an external impact to the joint is almost impossible.

Other objects, advantages, and novel features of the invention will become more apparent from the following detailed description when taken in conjunction with the accompanying drawings.

DETAILED DESCRIPTION OF THE PREFERRED EMBODIMENTS

Figure 3:
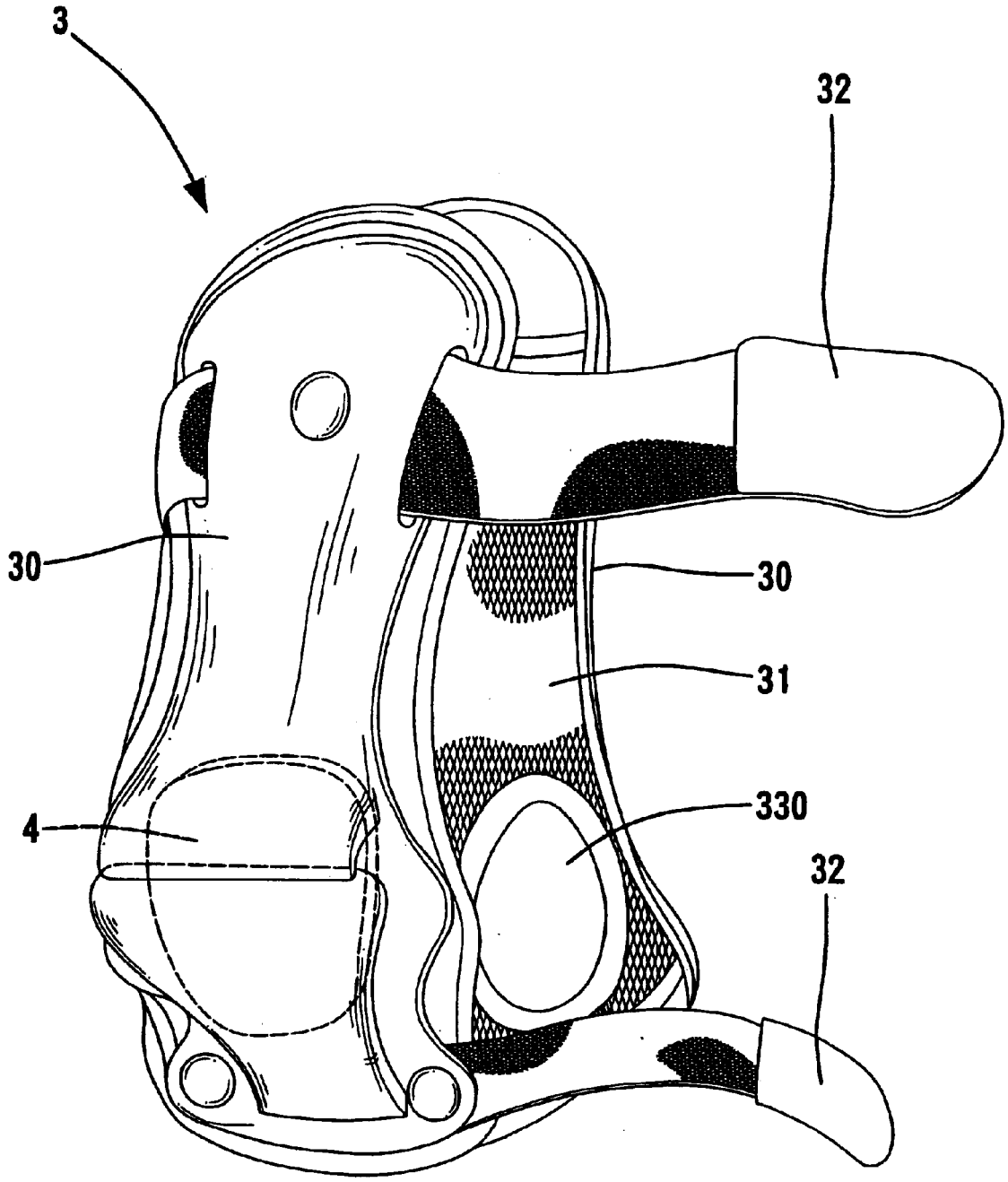
FIG. 3 is a perspective view of a wrist guard embodying a sports guard for sports in accordance with the present invention.
Figure 4:
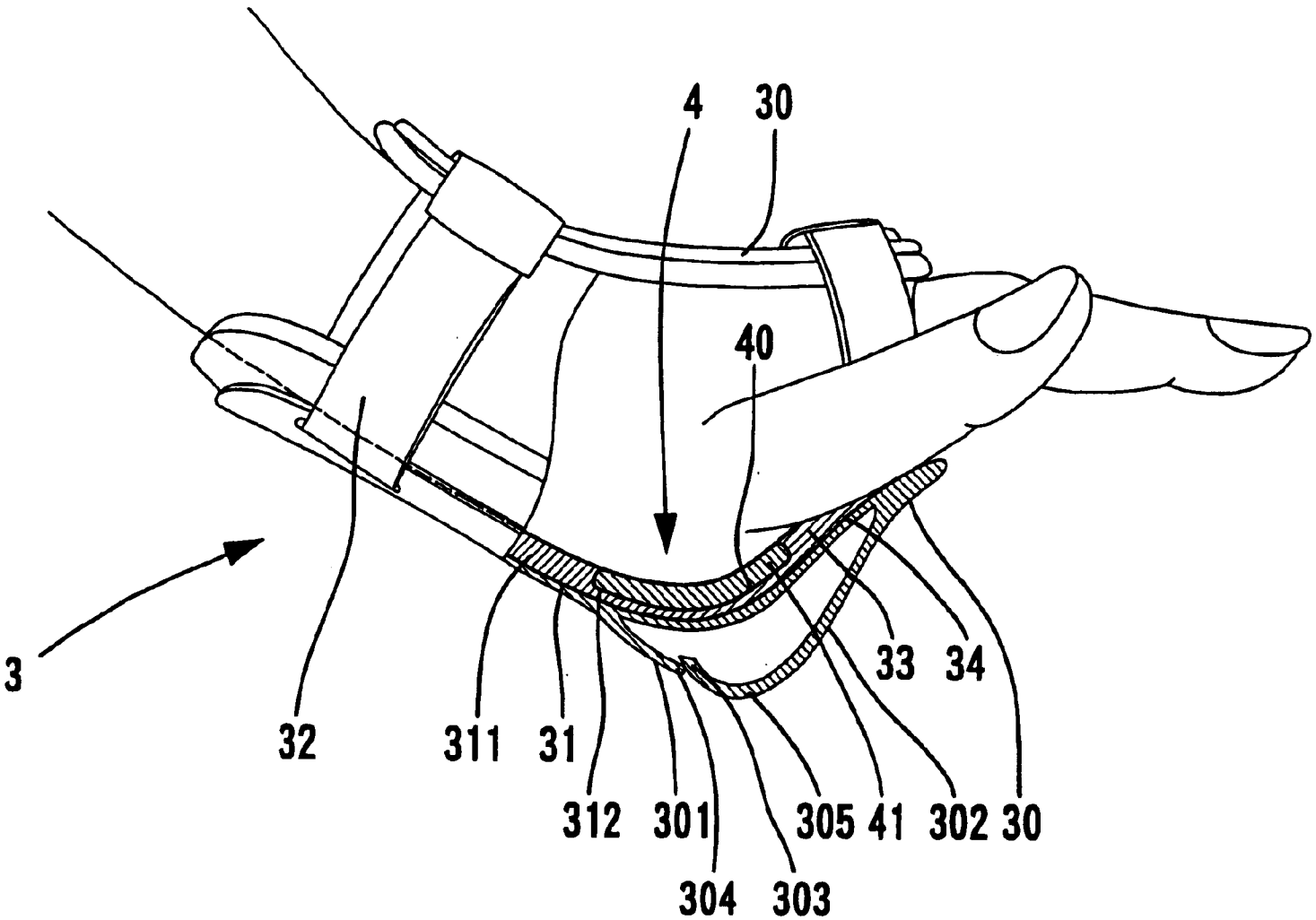
FIG. 4 is a schematic side view, partly sectioned, of the wrist guard in FIG. 3 in use.
Figure 5:
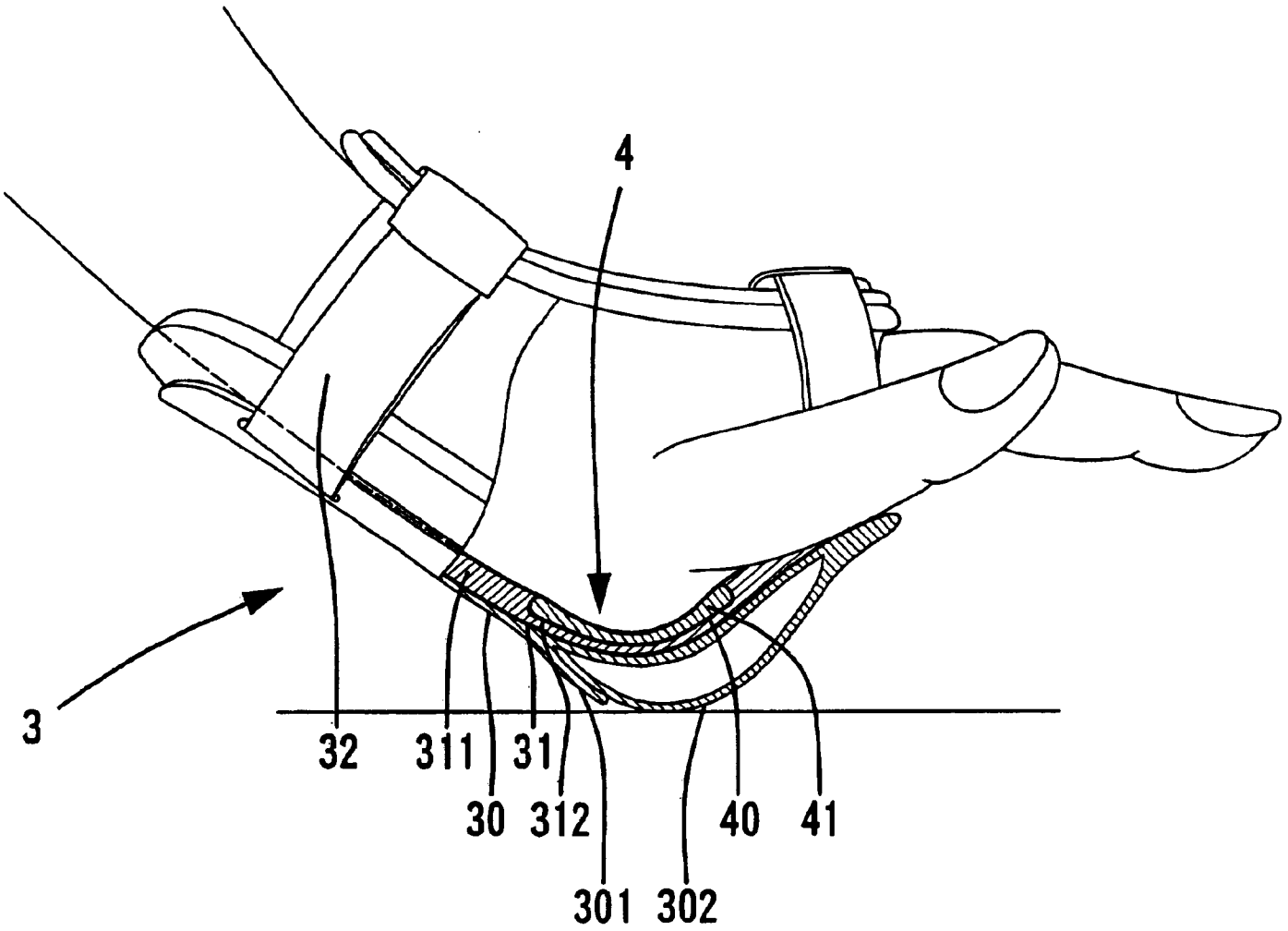
FIG. 5 is a view similar to FIG. 4, illustrating operation of the sports guard.

FIG. 3 illustrates a wrist guard embodying a sports guard in accordance with the present invention. FIG. 4 is a schematic side view, partly sectioned, of the wrist guard in FIG. 3 in use. FIG. 5 is a view similar to FIG. 4, illustrating operation of the sports guard.

The wrist guard 3 includes a hollow body having upper and lower pads 30 and two resilient knitted nets 31 each of which is mounted between the pads 30 and which are extended at lateral sides of the wrist guard 3, respectively. Two straps 32 are secured to the wrist guard 3. In use, the thumb of the user extends through a hole 330 in one of the nets 31 and the remaining fingers are exposed outside the wrist guard.

As illustrated in FIG. 4, the lower pad 30 includes a substrate 33 and an outer layer 34 outside the substrate 33. The substrate 33 includes a first shock absorbing member 311 (e.g., sponge) covered by upper and lower layers of elastic silk or nylon. The upper pad 30 may be identical to the lower pad 30 in the structure of the substrate 33 and the outer layer 34.

Figure 1:
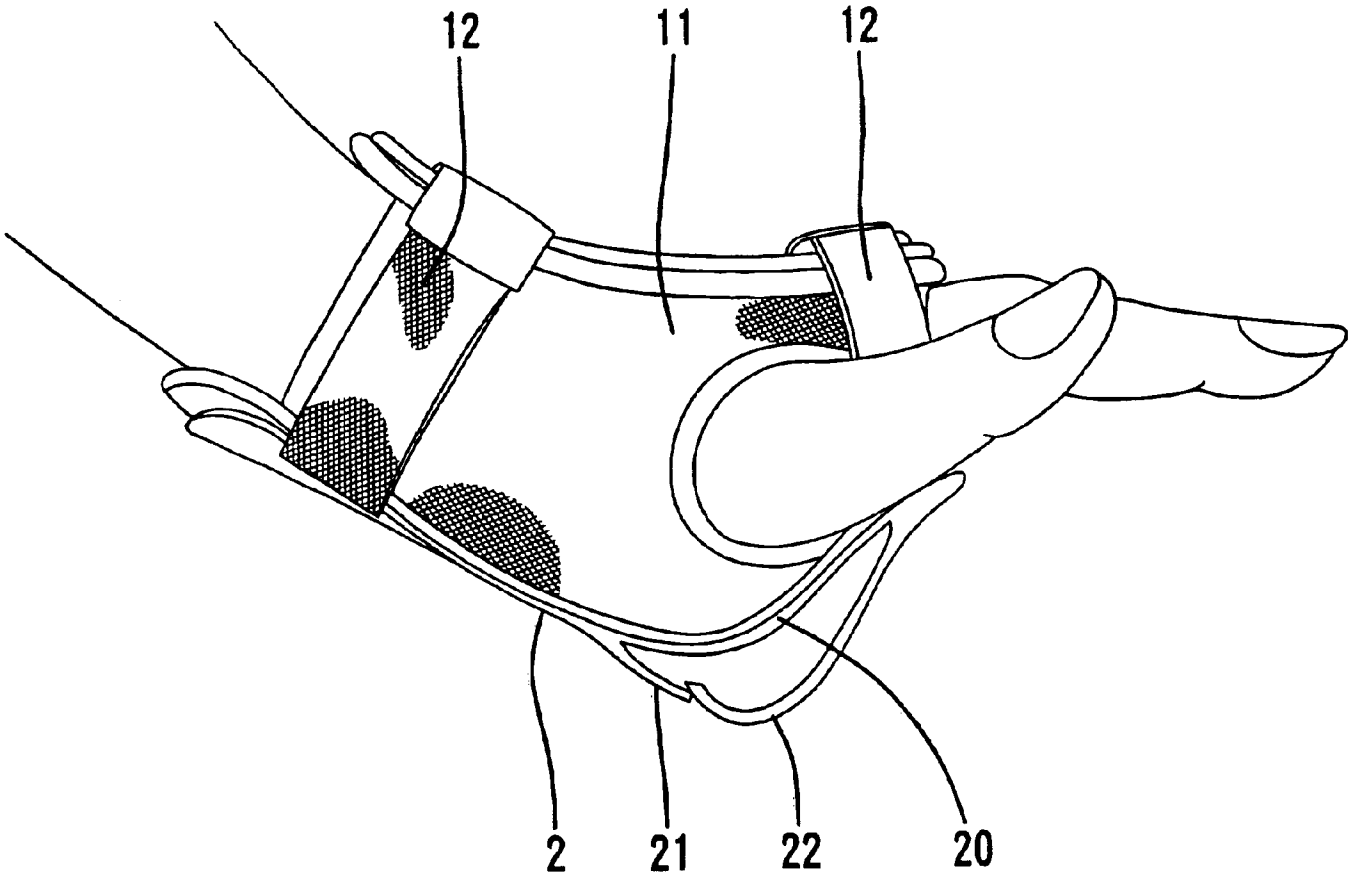
FIG. 1 PRIOR ART
FIG. 1 is a schematic view illustrating a conventional wrist guard for sports.
Figure 2:
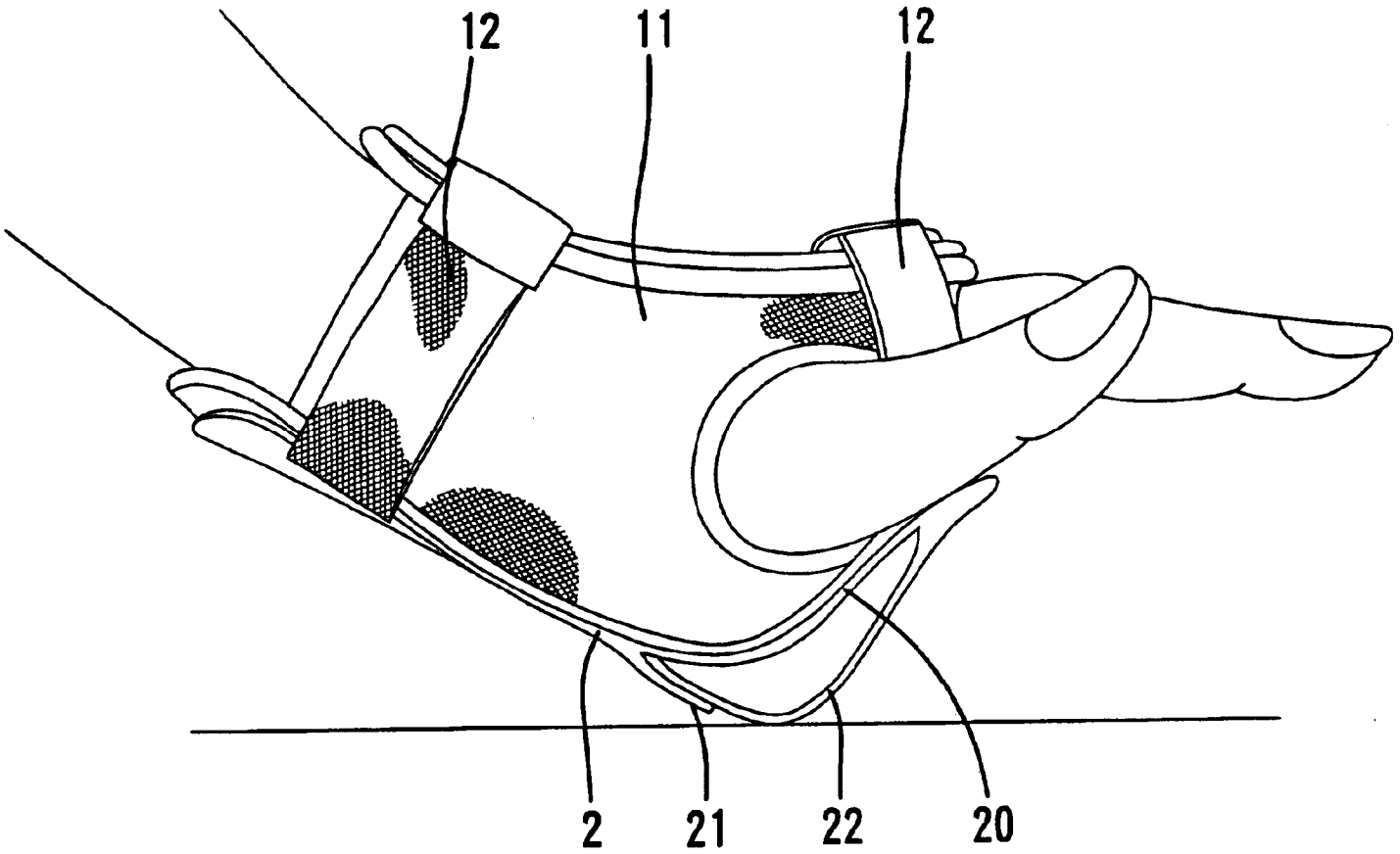
FIG. 2 is a view illustrating operation of the conventional wrist guard for absorbing impact.

A first resilient arcuate plate 301 projects from the outer layer 34 of the lower pad 30. A second resilient arcuate plate 302 projects from the outer layer 34 toward the first resilient arcuate plate 301 and has an end 303 in contact with an inner end edge 304 of a distal end of the first resilient arcuate plate 301. The curvature of the second resilient arcuate plate 302 has a vertex 305 which has a distance to the outer layer 34 longer than a distance between the distal end of the first resilient arcuate plate 301 and the outer layer 34. The first resilient arcuate plate 301 and the second resilient arcuate plate 302 are identical to those shown in FIGS. 1 and 2.

Of more importance, a second shock absorbing member 4 is embedded into an inner face of the substrate 33. The second shock absorbing member 4 is an elastomer 41 having a shock absorbing capacity greater than that of the first shock absorbing member 311. Preferably, the elastomer 41 is a thermoplastic elastomer, thermoplastic rubber, or gel covered by a rubber package 40 and then sewn to a specific section 312 of the inner face of the substrate 33. As illustrated in FIG. 4, the second shock absorbing member 4 is located in a position that corresponds to the joint of the wrist of the user wearing the wrist guard (or sports guard) in accordance with the present invention.

When the lower pad 30 touches the ground as a result of falling or sliding, as illustrated in FIG. 5 the second resilient arcuate plate 302 is deformed, with the distal end of the second arcuate plate 302 in contact with an inner end of the first arcuate plate 301, thereby absorbing the relative larger impact. The substrate 33 including the first shock absorbing member 311 also helps absorption of the impact. Further, the second shock absorbing member 4 also helps absorption of the impact. Since the second shock absorbing member 4 has a shock absorbing capacity greater than that of the first shock absorbing member 311, transmission of the impact to the wrist is almost impossible. Thus, compression fracture and injury to the cartilage of the joints of the user resulting from tremendous impact or accumulation of impacts are avoided.

Figure 6:
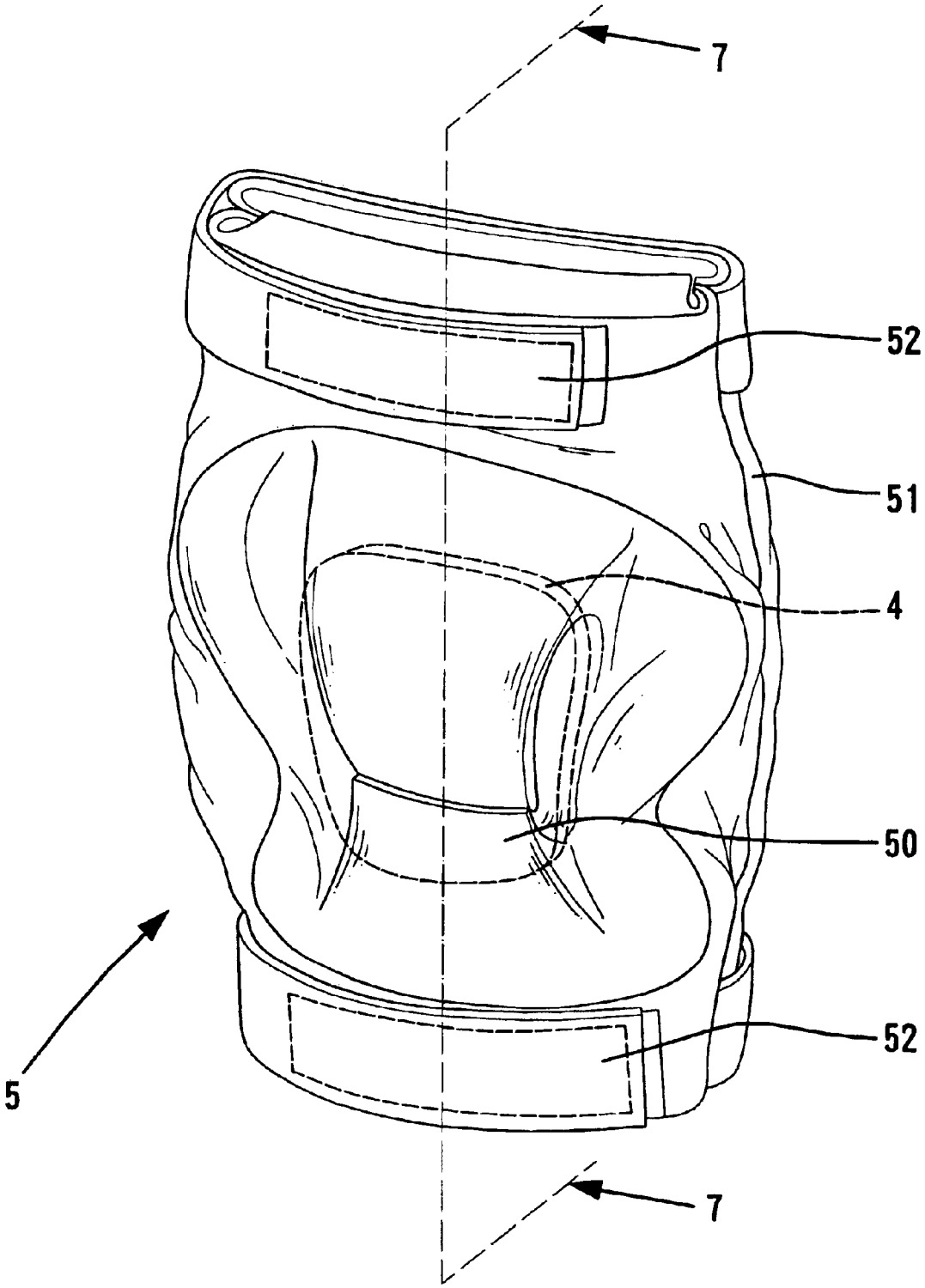
FIG. 6 is a perspective view of a knee guard embodying the sports guard for sports in accordance with the present invention.
Figure 7:
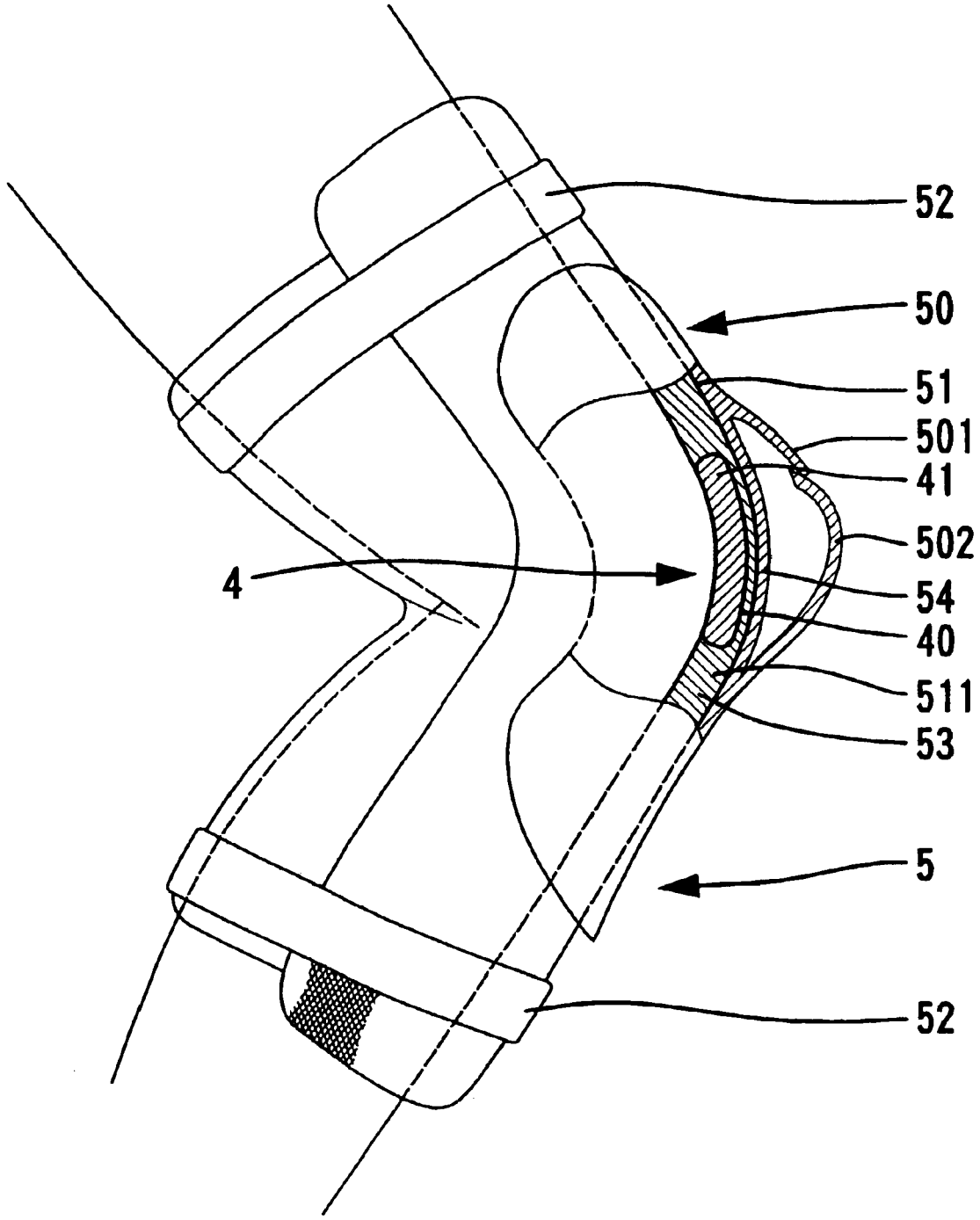
FIG. 7 is a schematic view, partly sectioned along plane 7—7 in FIG. 6, illustrating use of the knee guard.

FIG. 6 is a perspective view of a knee guard 5 embodying the sports guard in accordance with the present invention. Namely, the sports guard in accordance with the present invention is in the form of a knee guard 5. It is noted that the upper pad in the wrist guard is replaced with a web of resilient cloth or the like in the knee guard 5. FIG. 7 is a schematic view, partly sectioned along plane 7—7 in FIG. 6, illustrating use of the knee guard.

More specifically, the knee guard 5 includes a hollow body 51 having a front pad 50 and a rear web of resilient cloth (not labeled). Two straps 52 are secured to the knee guard 5. As illustrated in FIG. 7, the front pad 50 includes a substrate 53 and an outer layer 54 outside the substrate 53. The substrate 53 includes a first shock absorbing member 511 (e.g., sponge) covered by upper and lower layers of elastic silk or nylon.

A first resilient arcuate plate 501 projects from the outer layer 54 and a second resilient arcuate plate 502 projects from the outer layer 54 toward the first arcuate plate 501, which are identical to the first and second resilient arcuate plates 301 and 302 in the first embodiment.

Of more importance, a second shock absorbing member 4 is embedded into an inner face of the substrate 53. The second shock absorbing member 4 is an elastomer 41 having a shock absorbing capacity greater than that of the first shock absorbing material. Preferably, the elastomer 41 is a thermoplastic elastomer, thermoplastic rubber, or gel covered by a rubber package 40 and then sewn to a specific section (not labeled) of the inner face of the substrate 53. As illustrated in FIG. 7, the second shock absorbing member 4 is located in a position that corresponds to the joint of the knee of the user wearing the knee guard (or sports guard) in accordance with the present invention.

When the front pad 50 touches the ground as a result of falling or sliding, the second resilient arcuate plate 502 is deformed, with the distal end of the second resilient arcuate plate 502 in contact with an inner end of the first resilient arcuate plate 501, thereby absorbing the relative larger impact. The substrate 53 including the first shock absorbing member 511 also helps absorption of the impact. Further, the second shock absorbing member 4 also helps absorption of the impact. Since the second shock absorbing member 4 has a shock absorbing capacity greater than that of the first shock absorbing member 511, transmission of the impact to the knee of the user is almost impossible. Thus, compression fracture and injury to the cartilage of the joints of the user resulting from tremendous impact or accumulation of impacts are avoided.

Figure 8:
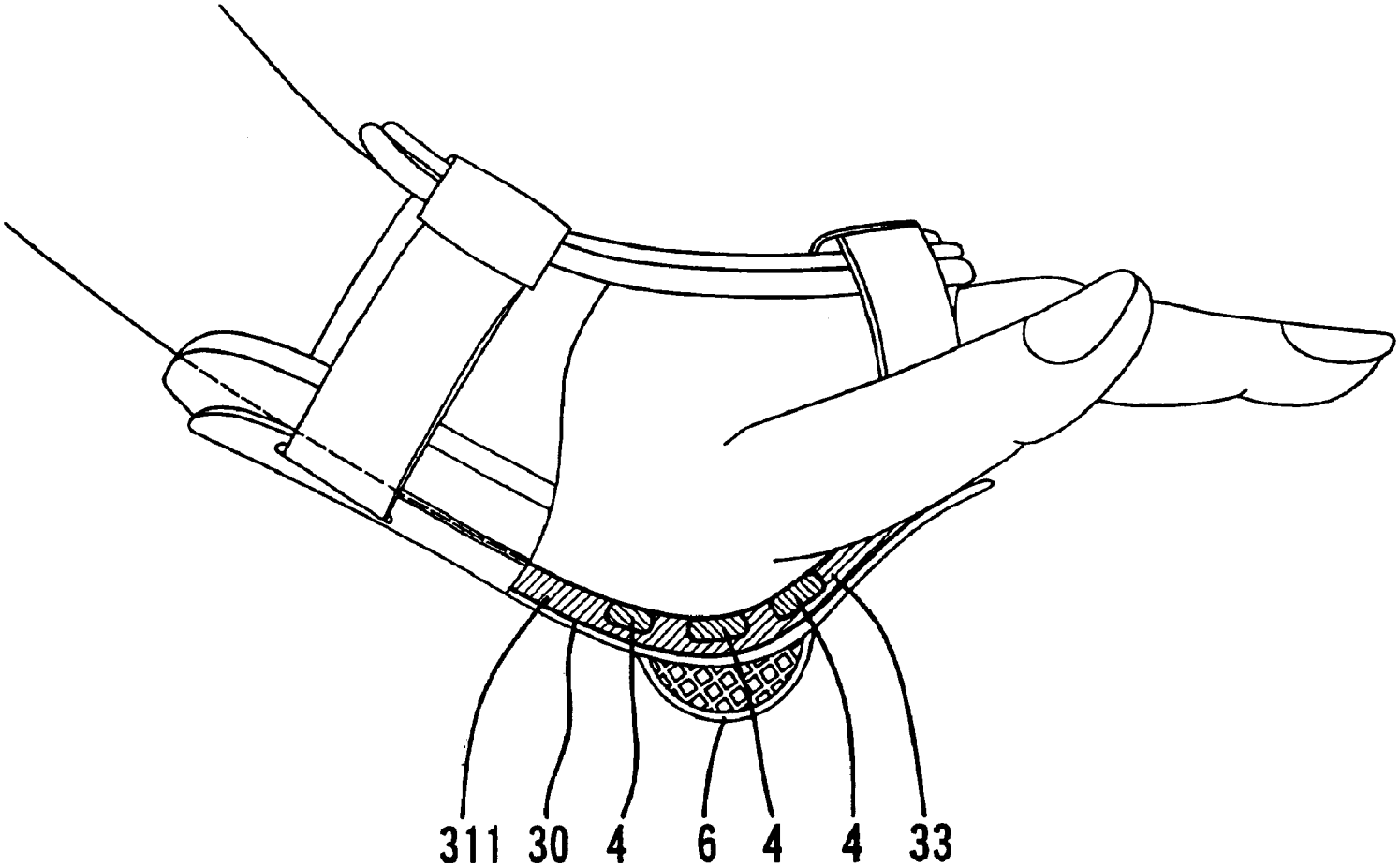
FIG. 8 is a view similar to FIG. 4, illustrating a modified embodiment of the sports guard in accordance with the present invention.

FIG. 8 is illustrates a modified embodiment of the guard device in accordance with the present invention, wherein the first and second resilient arcuate plates 301 and 302 in the first embodiment are replaced with a single shock absorbing member 6 that is integrally formed with the pad 30. Further, there are three shock absorbing members 4 embedded into the inner face of the first shock absorbing member 311 (or the substrate 33). The shock absorbing members 4 are spaced apart one from another and located in a position that corresponds to the joint of the wrist of the user wearing the wrist guard in accordance with the present invention.

Although the invention has been explained in relation to its preferred embodiment, it is to be understood that many other possible modifications and variations can be made without departing from the scope of the invention as hereinafter claimed.

What is claimed is:

1. A sports guard comprising a hollow body having a pad attached to a side thereof, the pad including a substrate and an outer layer, the substrate including a first shock absorbing member, a second shock absorbing member being embedded into at least one section of an inner face of the first shock absorbing member, the second shock absorbing member having a shock absorbing capacity greater than that of the first shock absorbing member and being located in a position corresponding to a joint of a user wearing the sports guard, wherein a first resilient arcuate plate projects from the outer layer, a second resilient arcuate plate projecting from the outer layer toward the first arcuate plate and having an end in contact with an inner end edge of a distal end of the first arcuate plate, a curvature of the second arcuate plate having a vertex which has a distance to the outer layer longer than a distance between a distal end of the first arcuate plate and the outer layer.

2. The sports guard as claimed in claim 1, wherein the second shock absorbing member includes an elastomer filled in a rubber package that is sewn to the inner face of the substrate.

3. The sports guard as claimed in claim 1, wherein the elastomer is selected from the group including thermoplastic elastomer, thermoplastic rubber, and gel.

* * * * *